US008565456B2

(12) United States Patent
Nishizaki et al.

(10) Patent No.: US 8,565,456 B2
(45) Date of Patent: Oct. 22, 2013

(54) HEARING AID

(75) Inventors: Makoto Nishizaki, Tokyo (JP); Yoshihisa Nakatoh, Fukuoka (JP)

(73) Assignee: Panasonic Corporation, Osaka (JP)

( * ) Notice: Subject to any disclaimer, the term of this patent is extended or adjusted under 35 U.S.C. 154(b) by 49 days.

(21) Appl. No.: 13/287,360

(22) Filed: Nov. 2, 2011

(65) Prior Publication Data

US 2012/0114155 A1 May 10, 2012

(30) Foreign Application Priority Data

Nov. 4, 2010 (JP) ..... 2010-247668

(51) Int. Cl.
*H04R 25/00* (2006.01)
*H04R 3/00* (2006.01)

(52) U.S. Cl.
USPC ..... 381/313; 381/122

(58) Field of Classification Search
USPC ..... 381/26, 23.1, 313, 315, 92, 356
See application file for complete search history.

(56) References Cited

U.S. PATENT DOCUMENTS

2010/0104120 A1* 4/2010 Steinbuss ..... 381/312

FOREIGN PATENT DOCUMENTS

JP 1-179599 * 7/1989

* cited by examiner

*Primary Examiner* — Brian Ensey
*Assistant Examiner* — Norman Yu
(74) *Attorney, Agent, or Firm* — Wenderoth, Lind & Ponack, L.L.P.

(57) ABSTRACT

A hearing aid, that outputs a microphone input signal and an external input signal, improved includes a directional microphone, an external input terminal, a hearing aid processor that inputs sound signals from the microphone and the external input terminal, and a receiver that outputs sound signal that have undergone hearing aid processing by the hearing aid processor. The hearing aid processor has a mixer that mixes a sound signal from the microphone with a sound signal from the external input terminal and outputs a sound signal to the receiver, a mixing ratio decider that decides a mixing ratio between the sound signal from the microphone and a sound signal from the external input terminal, a front sound detector that is connected to the mixing ratio decider, and a similarity calculator that determines whether or not sound collected by the directional microphone is that of an external device.

4 Claims, 11 Drawing Sheets

| | Front sound detection signal | |
|---|---|---|
| | Yes (1) | No (−1) |
| Forward ambient sound presence signal | | |
| Yes (1) (low correlation) | state S2 | |
| No (−1) (high correlation) | state S1 | state S3 |

FIG. 5

HEARING AID

BACKGROUND OF THE INVENTION

1. Field of the Invention

The present invention relates to a hearing aid with which a sound signal inputted from a television set or other such external device to an external input terminal (external input signal) is also outputted to a receiver in addition to a sound signal acquired by a microphone (microphone input signal).

2. Description of the Related Art

Recent years have seen proposals for a hearing aid with which the sound from a television set, a CD player, or another such external device is received directly from an external input terminal by wired or wireless means (such as Bluetooth), rather than being picked up through a microphone.

With such a hearing aid, the sound from a television set, a CD player, or another such external device can be enjoyed as clear, noise-free sound, making these hearing aids very popular with users.

On the other hand, with these hearing aids there is the possibility that the user will not be able to hear a family conversation received by the microphone when, for example, the family is seated at the dining table while watching television.

In view of this, Patent Literature 1 has disclosed a hearing aid with which a sound signal inputted by wire or wirelessly from a television set, an audio device, or another such external device to an external input terminal (external input signal) is mixed with a sound signal acquired by a microphone provided to the hearing aid (microphone input signal), and the mixed signal is provided from a receiver to the user.

With this hearing aid, if the sound pressure level of the sound signal acquired by the microphone (microphone input signal) is over a specified level, processing is performed to weaken the sound signal from the external device (external input signal), thereby solving the above-mentioned problem.

SUMMARY OF THE INVENTION

Problem to be Solved by the Invention

With the above-mentioned conventional hearing aid, however, the following problems are encountered.

With the hearing aid disclosed in the above-mentioned publication, the microphone input signal must be over a specified sound pressure level in order to perform processing in which the sound signal acquired by the microphone (microphone input signal) is given higher priority than the sound signal from the external device (external input signal). Accordingly, with this conventional constitution, when a soft voice (sound) is inputted to the microphone, processing is not performed in which the microphone input signal is given priority over the external input signal, so the user ends up "missing" what is said.

Meanwhile, if the threshold for the sound pressure level is lowered to prevent this "missing," the microphone signal ends up being given priority automatically when conversation is conducted in loud voices around the user, even though the user wants to hear the sound outputted from a television set or other such external device. Accordingly, with a conventional constitution, a problem is that television sound is difficult to hear even if the threshold at which the above-mentioned processing is performed is adjusted.

Thus, with a conventional hearing aid that outputted a microphone input signal and an external input signal, the user could not properly hear the desired sounds, which made it difficult to obtain a satisfactory hearing aid effect.

It is an object of the present invention to provide a hearing aid with which the hearing aid effect can be improved over that in the past with a constitution in which a microphone input signal and an external input signal are outputted.

Means for Solving Problem

The hearing aid pertaining to the first invention comprises a microphone, an external input terminal, a hearing aid processor, a receiver, a mixer, a similarity calculator, and a mixing ratio decider. The microphone acquires sound in the front direction of the face of the user in a state of being worn by the user. The external input terminal acquires input sound inputted from an external device. The hearing aid processor receives sound signals outputted from the microphone and the external input terminal, and subjects the sound signals to hearing aid processing. The receiver receives and outputs a sound signal that has undergone hearing aid processing at the hearing aid processor. The mixer mixes a sound signal inputted to the microphone with a sound signal inputted to the external input terminal, and outputs a sound signal to the receiver. The similarity calculator calculates the correlation between a sound signal inputted from the microphone and a sound signal inputted from the external input terminal. The mixing ratio decider decides the mixing ratio between the sound signal inputted to the microphone and the sound signal inputted to the external input terminal at the mixer, on the basis of the calculation result of the similarity calculator, and sends the result to the mixer.

Effects of the Invention

The hearing aid of the present invention is constituted as above, and because of this, when the user turns his face in the direction of something he wishes to hear, the microphone that acquires sound in the front direction of the user determines whether or not there is sound other than that from an external device (such as a television set) in front of the user's face, and distinguishes the sound the user wishes to hear from among the surrounding sounds. As a result, the sound signal inputted to the microphone and the sound signal inputted to the external input terminal can be mixed in a suitable mixing ratio and outputted, so the hearing aid effect can be improved over that achieved in the past.

BRIEF DESCRIPTION OF DRAWINGS

FIG. 5 is a table of the states in which detection is performed by the state detector included in the hearing aid in FIG. 1;

DETAILED DESCRIPTION OF THE INVENTION

A hearing aid 100 pertaining to an embodiment of the present invention will now be described through reference to FIGS. 1 to 10.

Figure 1:
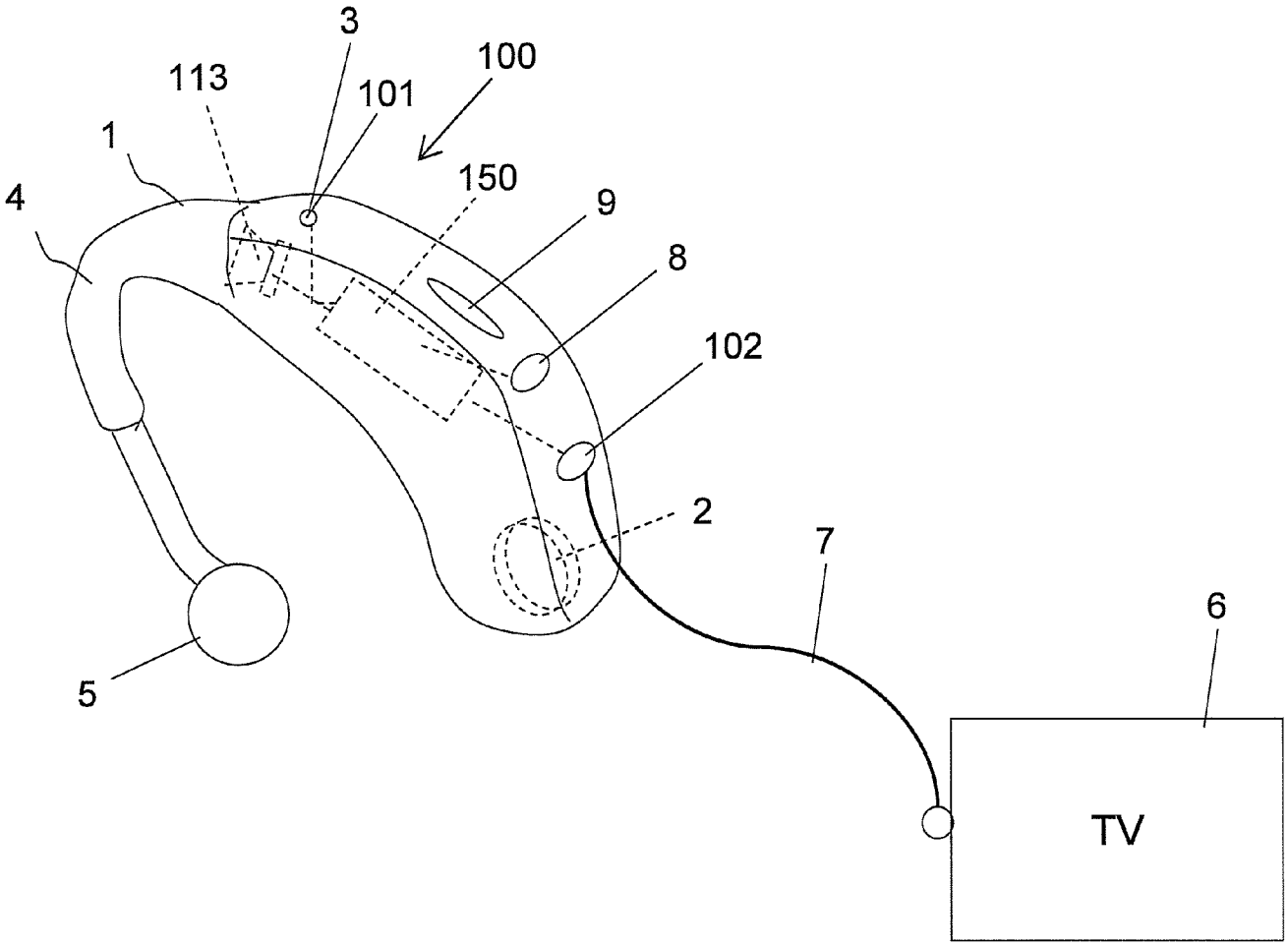
FIG. 1 is an oblique view of the constitution of a hearing aid pertaining to Embodiment 1 of the present invention.
Figure 2:
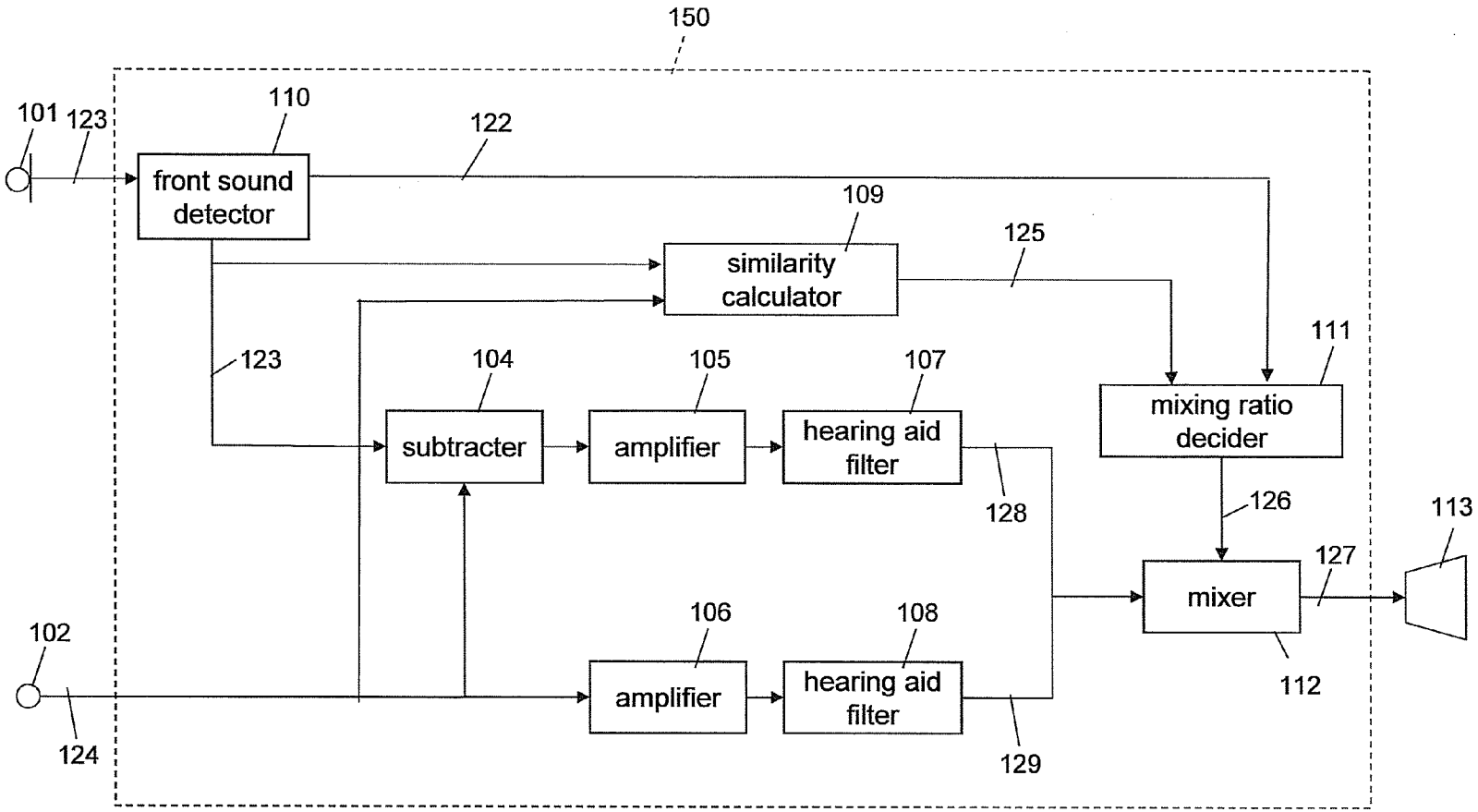
FIG. 2 is a block diagram of the hearing aid pertaining to Embodiment 1 of the present invention.

FIG. 1 is a view of the constitution of the hearing aid 100 pertaining this embodiment, and FIG. 2 is a control block diagram of the hearing aid 100 in FIG. 1. In FIGS. 1 and 2, 101 is a directional microphone, 102 is an external input terminal, 104 is a subtracter, 105 and 106 are amplifiers, 107 and 108 are hearing aid filters, 109 is a similarity calculator, 110 is a front sound detector, 111 is a mixing ratio decider, 112 is a mixer, and 113 is a receiver.

The hearing aid 100 of this embodiment is such that the directional microphone 101, the external input terminal 102, the subtracter 104, the amplifiers 105 and 106, the hearing aid filters 107 and 108, the similarity calculator 109, the front sound detector 110, the mixing ratio decider 111, the mixer 112, and the receiver 113 are housed in a main body case 1 and driven by a battery 2.

The directional microphone 101 passes through an opening 3 formed in the surface of the main body case 1 to the outside of the main body case 1.

The receiver 113 is linked via a curved ear hook 4 to a mounting portion 5 that is inserted into the eustachian tube of the user. The receiver 113 outputs sound in a volume that has been set with a volume control 9 exposed on the outer surface of the main body case 1.

The external input terminal 102 is provided so that sound outputted from a television set 6 (an example of an external device) can be inputted directly to the hearing aid 100, allowing the user to enjoy the television set 6 with clear, noise-free sound. When the hearing aid 100 and the television set 6 are connected by wire, the connection terminal of a communication lead wire 7 can be used as the external input terminal 102. When the hearing aid 100 and the television set 6 are connected wirelessly, a wireless communication antenna can be used as the external input terminal 102.

A hearing aid processor 150 is constituted so as to include the subtracter 104, the amplifiers 105 and 106, the hearing aid filters 107 and 108, the similarity calculator 109, the front sound detector 110, the mixing ratio decider 111, and the mixer 112. 8 in FIG. 1 is a power switch, which is operated by the user to turn the power to the hearing aid 100 on and off. 9 is a volume control, which adjusts (increases or decreases) the output of sound inputted to the directional microphone 101.

The hearing aid 100 shown in FIG. 1 is a behind-the-ear type of hearing aid, which is worn so that the main body case 1 is behind the ear when the ear hook 4 is hooked over the top of the ear. The mounting portion 5 is used in a state of being inserted into the eustachian tube of the user.

The directional microphone 101 acquires sound that is emitted from a sound source in front of the user of the hearing aid 100 (that is, the sound that the user can hear from the front), and outputs this as a microphone input signal 123 to the similarity calculator 109 and the subtracter 104.

The range of the front of the user over which sound is acquired by the directional microphone 101 is defined as follows.

The viewing angle of an average person is 90 to 105 degrees to each of the left and right, using the front direction of the face as 0 degrees (that is, the angle is from 180 to 210 degrees in the left and right directions in front of the face). Of this viewing angle, if we consider the range of the effective viewing angle (4 to 20 degrees in front of the face), which is the range over which a person can discern things relatively clearly, the front of the face of the user is defined as a range of 20 to 40 degrees in the left and right directions. Thus, the directional microphone 101 is preferably set up so as to pick up sounds that can be heard in front of the user's face (a range of 20 to 40 degrees in the left and right directions).

Meanwhile, the external input terminal 102 directly inputs sounds outputted from the television set 6, via the lead wire 7 or another such wired means, or via Bluetooth, FM radio, or another such wireless mean. The sound inputted to the external input terminal 102 is outputted as an external input signal 124 to the similarity calculator 109, the subtracter 104, and amplifier 106.

The subtracter 104 makes use of sound from the television set 6, a CD, or the like inputted from the external input terminal 102, performs noise cancellation processing to cancel out the sound of the television set 6 that finds its way into the directional microphone 101, and outputs the result to the amplifier 105. A method in which the phase of the external input is inverted and subtracted from the microphone input, for example, may be used for the noise cancellation processing.

The amplifier 105 amplifies the microphone input signal 123 inputted from the directional microphone 101, and outputs the result to the hearing aid filter 107.

The amplifier 106 amplifies the external input signal 124 inputted from the external input terminal 102, and outputs the result to the hearing aid filter 108.

The hearing aid filters 107 and 108 perform hearing aid processing according to the hearing ability of the user, and output a microphone input hearing aid signal 128 and an external input hearing aid signal 129 to the mixer 112.

The front sound detector 110 determines whether or not a front signal is included on the basis of the acquired microphone input signal 123. If the front sound detector 110 determines that sound from the front direction of the user's face is included, the determination result is "+1," and if it determines that no such sound is included, the result is "−1," one of which is outputted as a front sound detection signal 122 to the mixing ratio decider 111.

The similarity calculator 109 finds the degree of correlation between the microphone input signal 123 inputted from the directional microphone 101 and the external input signal 124 inputted from the external input terminal 102. If it is decided that the correlation between the two signals is low, then it is determined that there is a different signal between the microphone input signal 123 and the external input signal 124, that is, that a sound is heard that can be acquired by the directional microphone 101 in the front direction of the user's face. The similarity calculator 109 outputs a forward ambient sound presence signal 125 of "+1" if there is a sound different from the external input in the front direction of the user's face, and "−1" otherwise, to the mixing ratio decider 111.

The mixing ratio decider 111 determines, on the basis of the front sound detection signal 122 and the forward ambient sound presence signal 125, the proportion in which the microphone input hearing aid signal 128 that has undergone hearing aid processing and been outputted from the hearing aid filters 107, and the external input hearing aid signal 129 that has undergone hearing aid processing and been outputted from the hearing aid filters 108 should be mixed and outputted from the receiver 113, and thereby decides the mixing ratio (also expressed as a priority).

The mixer 112 mixes the microphone input hearing aid signal 128 and external input hearing aid signal 129 that have undergone hearing aid filter processing, according to the mixing ratio decided on the basis of a mixing ratio signal 126 sent from the mixing ratio decider 111, and outputs a mixing signal 127 to the receiver 113.

The receiver 113 outputs the mixing signal 127 received from the mixer 112. The hearing aid processing performed by the hearing aid processor 150 can involve known technology such as an NAL-NL1 method (see, for example, "Handbook of Hearing Aids," by Harvey Dillon, translated by Masafumi Nakagawa, p. 236).

Detailed Configuration of Mixing Ratio Decider 111

Figure 3:
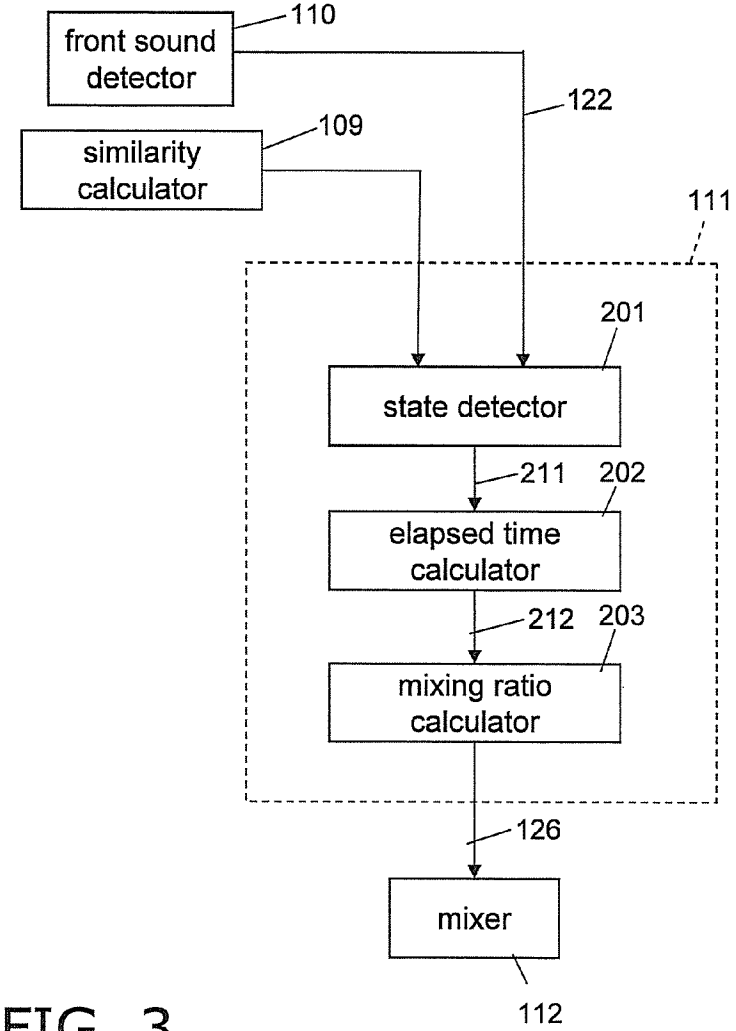
FIG. 3 is a block diagram of the mixing ratio decider installed in the hearing aid in FIG. 2.

FIG. 3 is a diagram of the detailed configuration of the mixing ratio decider 111 shown in FIG. 2.

As shown in FIG. 3, the mixing ratio decider 111 has a state detector 201, an elapsed time calculator 202, and a mixing ratio calculator 203.

The state detector 201 distinguishes the state of the user according to whether there is a front sound and the type of front sound, and outputs a state signal 211.

The elapsed time calculator 202 calculates how long the above-mentioned state has continued on the basis of the state signal 211. The elapsed time calculator 202 then outputs a duration-attached state signal 212 produced on the basis of the above-mentioned state and its duration, to the mixing ratio calculator 203. If there has been a change in the above-mentioned state detected by the state detector 201, the duration is reset to zero.

The mixing ratio calculator 203 holds a mixing ratio $\alpha$ that expresses the proportion in which the microphone input hearing aid signal 128 and the external input hearing aid signal 129 should be mixed. The mixing ratio calculator 203 updates the value of the mixing ratio $\alpha$ on the basis of the mixing ratio $\alpha$ and the duration-attached state signal 212, and outputs a mixing ratio signal 126 indicating this mixing ratio $\alpha$ to the mixer 112. The mixing ratio $\alpha$ is an index indicating that the microphone input hearing aid signal 128 is mixed in a proportion $\alpha$, and the external input hearing aid signal in a proportion $(1-\alpha)$.

Operation of Hearing Aid 100

Figure 4:
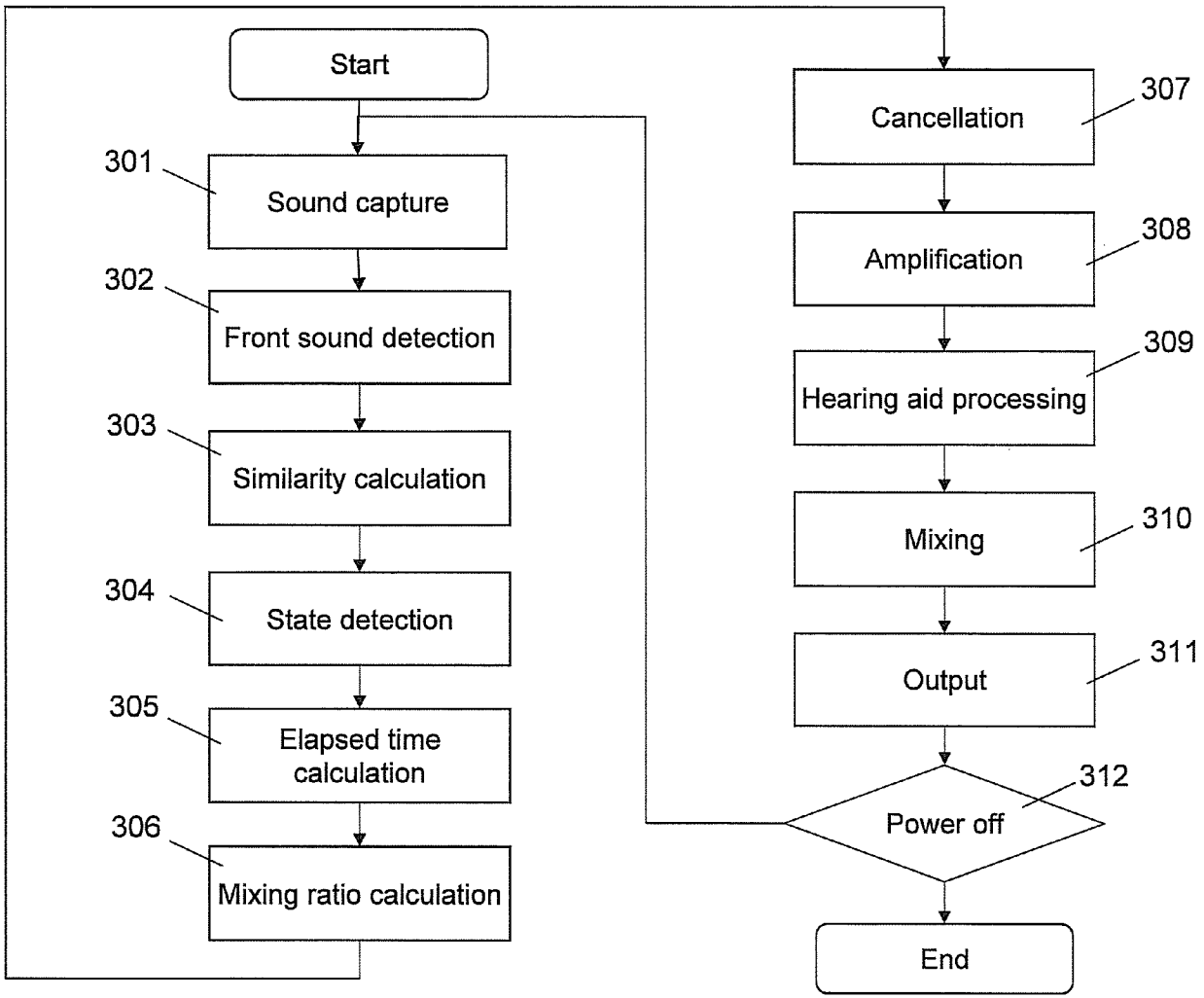
FIG. 4 is a flowchart of the operation of the hearing aid in FIG. 1.

Using the flowchart in FIG. 4, the operation of the hearing aid 100 in this embodiment will be described, assuming that the user of the hearing aid 100 constituted as above is conversing with his family while watching the television set 6 at home.

First, in step 301 (sound capture step), sound in front of the user (in the front direction of the face) is acquired by the directional microphone 101, and the sound of the television set 6 is acquired via the external input terminal 102.

Then, in step 302 (front sound detection step), whether or not the sound is coming from the front is determined on the basis of the sound in the front direction of the user's face acquired by the directional microphone 101, and a front sound detection signal is outputted. Whether or not the sound is coming from the front may be determined, for example, on the basis of the sound pressure level acquired by the directional microphone 101.

Then, in step 303 (similarity calculation step), the similarity calculator 109 finds a correlation coefficient (correlation) between the microphone input signal 123 inputted through the directional microphone 101, and the external input signal 124 inputted through the external input terminal 102. If the correlation coefficient here is not high (such as if the correlation coefficient is 0.9 or less), the similarity calculator 109 concludes that there is a different sound between the microphone input signal 123 and the external input signal 124. Consequently, it can be detected that there are family members conversing in the front direction of the user's face. The above-mentioned calculation of the correlation coefficient may be performed on a sound inputted within the nearest 200 msec. The similarity calculator 109 then outputs a forward ambient sound presence signal ("1" is there is conversation, and "−1" otherwise) to the mixing ratio decider 111.

Next, in step 304 (state detection step), what kind of state the user is in is detected on the basis of the forward ambient sound presence signal 125 acquired by the similarity calculator 109 in step 302 and the front sound detection signal 122 acquired by the front sound detector 110 in step 303.

As shown in FIG. 5, the state of the user here is expressed by a combination of the forward ambient sound presence signal 125, which expresses whether sound other than that of the television set 6 is being inputted from the directional microphone 101 (that is, whether there is family conversation), and the front sound detection signal 122, which indicates whether there is sound in the front direction of the user's face.

Usually, in a state S1, in which the sound from in front of the user's face is from the television set 6, it is presumed that the user is paying attention to the audio from the television set 6.

In a state S2 in which the sound from the front is not from the television set 6, the user is assumed to be paying attention to sound that is not from the television set 6 located in front (that is, the voices of the family member that are in front).

A state S3 in which there is no sound from the front is assumed to be a state in which talking has stopped in the middle of conversation, or a state in which the user is facing in a direction in which there is no sound at all. If there is no sound at all in front of the user, this is assumed to be a state in which equal attention is being paid to the television set 6 and to the surrounding sound. Even if the user is waiting for someone else to speak, it is unknown at that instant whether or not someone will in fact speak. Therefore, this is not assumed to be a state in which the user is especially trying to listen to a sound in the front direction of his face, but rather a state in which the user is waiting for the next sound to pay attention to, either a sound from the television set 6 or a sound from his surroundings, including straight ahead.

Then, in step 305 (elapsed time calculation step), how long the state detected in step 304 has continued is calculated, and the duration-attached state signal 212 is outputted to the mixing ratio calculator 203. If at this point there has been a change in the state detected in step 304, the duration is reset to zero, but if there has been no change in the state, the duration is updated.

Then, in step 306 (mixing ratio calculation step), the mixing ratio $\alpha$ is updated by the following formula on the basis of the duration-attached state signal 212 and the immediately prior mixing ratio $\alpha$.

Here, if we let the time $t_{in}$ at which there is a switch to each state be the duration in said state, $\alpha_{initial}$ be the initial value of $\alpha$ when there is a switch to each state, $\alpha_{max}$, $\alpha_{min}$, and $\alpha_{center}$ be the respective maximum, minimum, and center values of $\alpha$, $\alpha$ be the proportion by which $\alpha$ is increased according to the duration $t_{in}$, b be the proportion by which $\alpha$ is decreased according to the duration $t_{in}$, and b be the empty time required for a normal person to take a breath in between utterances (approximately three seconds), then the value of the mixing ratio $\alpha$ at the time $t_1+t_{in}$ elapsed since the beginning of each state can be calculated from the following Formula 1.

[First Mathematical Formula]

(when $t_{in}=0$)

$$\alpha(t_1+t_{in})=\alpha_{initial} \quad \text{Formula 1}$$

(when $t_{in}\geq 1$) a different update formula is used for each state.

In state S1:

$$\alpha(t_1+t_{in})\leftarrow -b\cdot t_{in}+\alpha(t_1+t_{in}-1)$$

if $\alpha(t_1+t_{in})<\alpha_{min}$, then $\alpha(t_1+t_{in})=\alpha_{min}$

In state S2:

$$\alpha(t_1+t_{in})\leftarrow \alpha\cdot t_{in}+\alpha(t_1+t_{in}-1)$$

if $\alpha(t_1+t_{in})>\alpha_{max}$, then $\alpha(t_1+t_{in})=\alpha_{max}$

In state S3:

when $0<t_{in}<Lp$: $\alpha(t_1+t_{in})\leftarrow \alpha(t_1+t_{in}-1)$ when $Lp<t_{in}$: $\alpha(t_1+t_{in})\leftarrow -b\cdot t_{in}+\alpha(t_1+t_{in}-1)$ if $\alpha(t_1+t_{in})<\alpha_{center}$, then $\alpha(t_1+t_{in})=\alpha_{center}$ In this embodiment, by calculating the mixing ratio $\alpha$ according to Formula 1 above, the mixing ratio $\alpha$ from when family conversation is detected in front of the user can be increased to the maximum mixing ratio $\alpha_{max}$ in state S2, which assumes a situation in which the user is interested in the conversation of a family member in front of the user. The input of the microphone input hearing aid signal 128 can be given priority over the external input hearing aid signal 129 by increasing the value of this mixing ratio $\alpha$ to at least 0.5.

In state S1 in which the television set 6 is in front of the user and the user is listening to the sound of the television set 6, the mixing ratio $\alpha$ is reduced from the initial value $\alpha_{initial}$ to the minimum value $\alpha_{min}$. This allows the priority of the external input hearing aid signal 129 to be raised over that of the microphone input hearing aid signal 128, so the external input sound can be listened to with priority over the microphone input sound. Specifically, in this case the sound of the television set 6 can be listened to with priority over the microphone input sound.

Also, in state S3 in which there is no sound in front of the user, it is possible that this is a state in which there is no sound from the front direction of the face because the conversation has stopped. Accordingly, the system waits the time Lp required for the other person to start talking again, until the other person begins talking while the immediately prior mixing ratio is maintained. However, if the Lp elapses and there is still no conversation, the value of the mixing ratio $\alpha$ is lowered so as to reduce the priority of the microphone input signal 123 from the directional microphone 101 and allow the user to pay attention to other sounds. At this point the mixing ratio $\alpha$ can be controlled without interfering with which sound the user next focuses on, by gradually bringing the mixing ratio to $\alpha_{center}$. This produces a state in which the user can properly hear both the microphone input hearing aid signal 128 and the external input hearing aid signal 129, and will not miss any important information.

As discussed above, in step 306 (mixing ratio calculation step), a new mixing ratio is calculated according to the most recent state on the basis of the state of the user, the duration of each state, and the current mixing ratio.

In step 307 (cancellation), the subtracter 104 arranges the gain of the microphone input signal 123 and the external input signal 124, and subtracts the external input signal 124 from the microphone input signal 123. This allows the subtracter 104 to extract a signal corresponding to the surrounding conversation situation, and output the result to the amplifier 105.

In step 308 (amplification step), the signals inputted to the amplifiers 105 and 106 are amplified and outputted to the hearing aid filters 107 and 108.

In step 309 (hearing aid processing step), the microphone input signal 123 and the external input signal 124 amplified in step 308 are filtered by the hearing aid filters 107 and 108 and divided up into a plurality of frequency bands, and gain adjustment is performed for each frequency band. The hearing aid filters 107 and 108 then output the results as the microphone input hearing aid signal 128 and the external input hearing aid signal 129 to the mixer 112.

In step 310 (mixing step), the mixer 112 produces a mixing signal by mixing the microphone input hearing aid signal 128 and external input hearing aid signal 129 obtained in step 309, on the basis of the mixing ratio $\alpha$ obtained in step 306.

In step 311 (output step), the mixer 112 outputs the mixing signal 127 to the receiver 113.

In step 312 (power off step), the system detects whether or not a power switch 8 is in the off position. If the power switch 8 is not in the off position, the flow returns to step 301 and the processing is repeated. On the other hand, if the power switch 8 is in the off position, processing is ended.

More Detailed Operation of Hearing Aid 100

The specific operation of the hearing aid 100 in this embodiment will now be described through reference to FIGS. 6(*a*) to 6(*e*).

Figure 6:
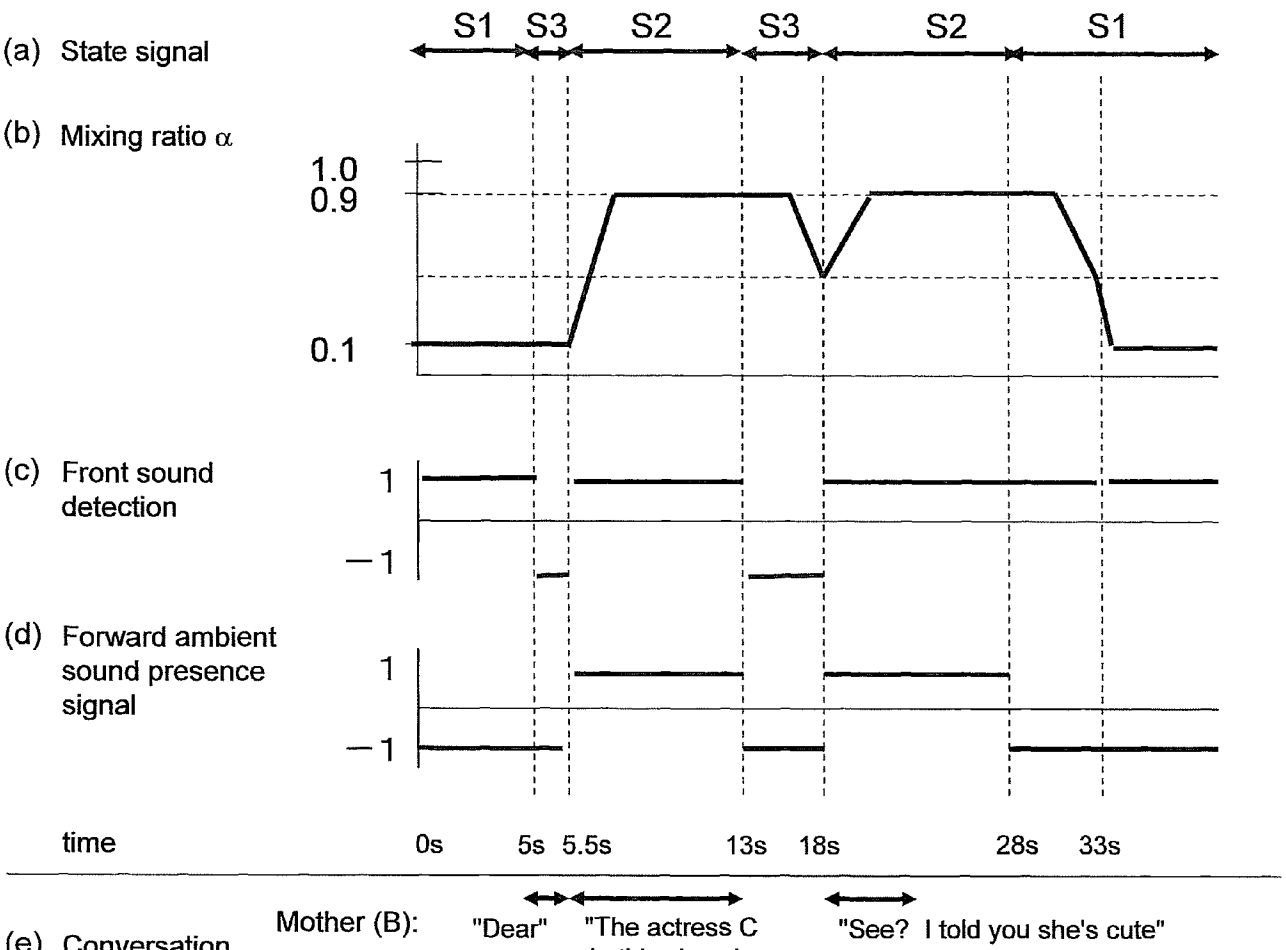
FIGS. 6(*a*) to 6(*e*) are diagrams illustrating a specific operation example for the hearing aid in FIG. 1.
Figure 7:
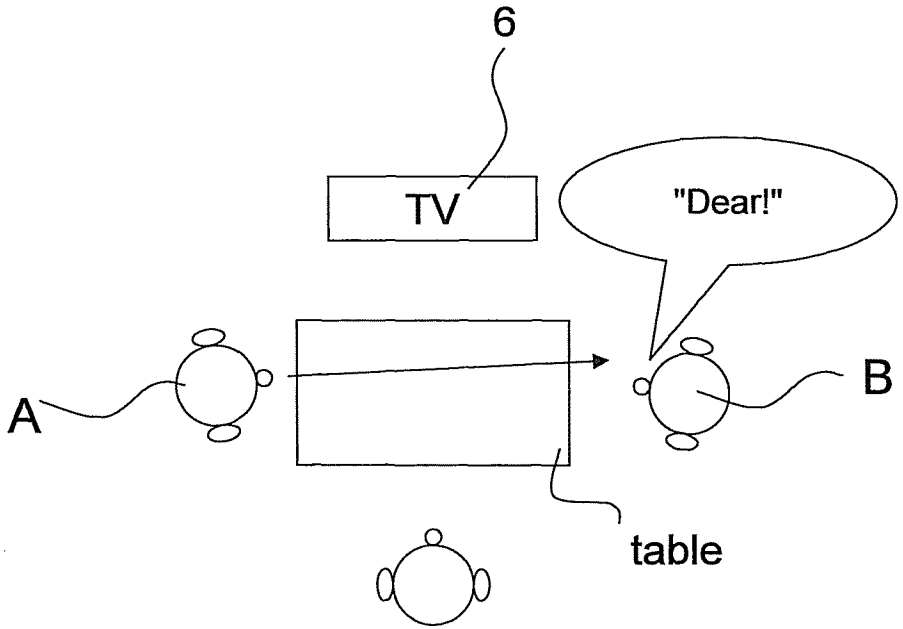
FIG. 7 is a diagram illustrating a specific operation example for the hearing aid in FIG. 1.

In FIGS. 6(*a*) to 6(*e*) and FIG. 7, we assume a situation in which a family member (mother B) is talking to the user (father A) of the hearing aid 100 while the user is watching a program on the television set 6 at home.

More specifically, an example will be described in which, five seconds after the start of processing by the hearing aid 100, the mother B says in a low voice to the father A, "Dear, the actress C in this show is cute, isn't she?," and a little while (18 seconds) later, the smiling face of the actress C appears on the television set 6, and the mother B excitedly and loudly says "See? I told you she's cute," seeking agreement from the father A. To this, the father A replies, "Yeah, I guess she is."

The above-mentioned conversation example is shown in FIG. 6(*e*), a forward ambient sound presence signal in FIG. 6(*d*), a front sound detection signal in FIG. 6(*c*), a mixing ratio signal in FIG. 6(*b*), and a state signal in FIG. 6(*a*).

Also, we will let $\alpha_{initial}$, which is the initial value of the mixing ratio $\alpha$, be 0.1, $\alpha_{min}$ be 0.1, $\alpha_{max}$ be 0.9, $\alpha_{center}$ be 0.5, and Lp be 3. Since the initial value $\alpha_{initial}$ of the mixing ratio $\alpha$ is 0.1, the processing starts from mixing ratio $\alpha$=0.1.

As shown in FIG. 6(*e*), for the first five seconds after the start of processing there is no conversation among the family members, and the father is just watching the television set 6, so state S1 is determined, and the minimum value of the mixing ratio $\alpha$ is still 0.1. Therefore, sound from the television set 6 (the external input terminal 102) and the sound of the microphone input signal 123 are mixed in a ratio of 9:1 and outputted from the receiver 113.

Next, five seconds after the start of processing, the mother B says to the father A, "Dear, the actress C in this show is cute, isn't she?" At this point, the proportion of the microphone input signal 123 is only 0.1, but upon being called, the father A turns toward the mother B, which interrupts the front sound while the father is turning away from the television set 6 toward the mother, and the front sound is detected at the point when the father is facing the mother. Since the sound is now a spoken voice rather than audio from the television set 6, (−1)

is outputted as the forward ambient sound presence signal 125. Specifically, the state signal 211 changes to the state S2, going through the state S3.

In the state S2, the above-mentioned Formula 1 is used, and one second after the change to the state S2 the mixing ratio $\alpha$ is increased, which raises the mixing ratio of the microphone input signal 123, making it easier for the father to hear the microphone input signal 123. This allows the father A to heat the mother B when she says, "The actress C in this show is cute, isn't she?"

13 seconds after the start of processing, the state changes to S3 after the conclusion of the voice input of "The actress C in this show is cute, isn't she?" After the change to the state S3, the mixing ratio $\alpha$ is maintained while there is a possibility of further conversation (Lp). Then, after the time $t_{in}$ that has elapsed since the change to the state S3 exceeds Lp, the mixing ratio $\alpha$ is lowered to $\alpha_{center}$.

Next, 18 seconds after the start of processing, the actress C reappears on the screen of the television set 6, and seeing this, the mother B says, "See? I told you she's cute." At this point, the state changes back to S2 and the value of the mixing ratio $\alpha$ again rises to 0.9, so the father A can hear what the mother B says without missing anything, and can give his assent by replying, "Yeah, I guess she is."

With a conventional method for controlling the mixing ratio by means of sound pressure, processing is performed only when the speech of the mother B has exceeded a specific sound pressure level. Accordingly, if her utterance of "Dear, the actress C in this show is cute, isn't she?" five seconds after the start of processing is made in a low voice as in this conversation example, no control in which the mixing ratio is changed will be performed, so the father cannot hear this utterance. Because of this, the father will not understand what the mother B means when, 18 seconds after the start of processing, she sees the smiling face of the actress C that has appeared on the screen of the television set 6 and says "See? I told you she's cute." Therefore, effective communication is impossible.

In contrast, with the hearing aid 100 of this embodiment, communication can be held that was impossible in the past, which is made possible by improving the hearing aid effect over that in the past as discussed above.

In another example of the processing of the hearing aid 100, the user (the father A) is watching the news on the television set 6 at home, while around him children D and E are playing a game and the mother B is trying to stop the children D and E from playing this game.

Here, we will assume a situation in which the father A is not really involved in this conversation, and is looking at the television page of a newspaper F in order to find out what programs other than the news are being shown on the television set 6. This will be described through reference to FIGS. 8(*a*) to 8(*e*) and FIGS. 9 and 10.

Figure 8:
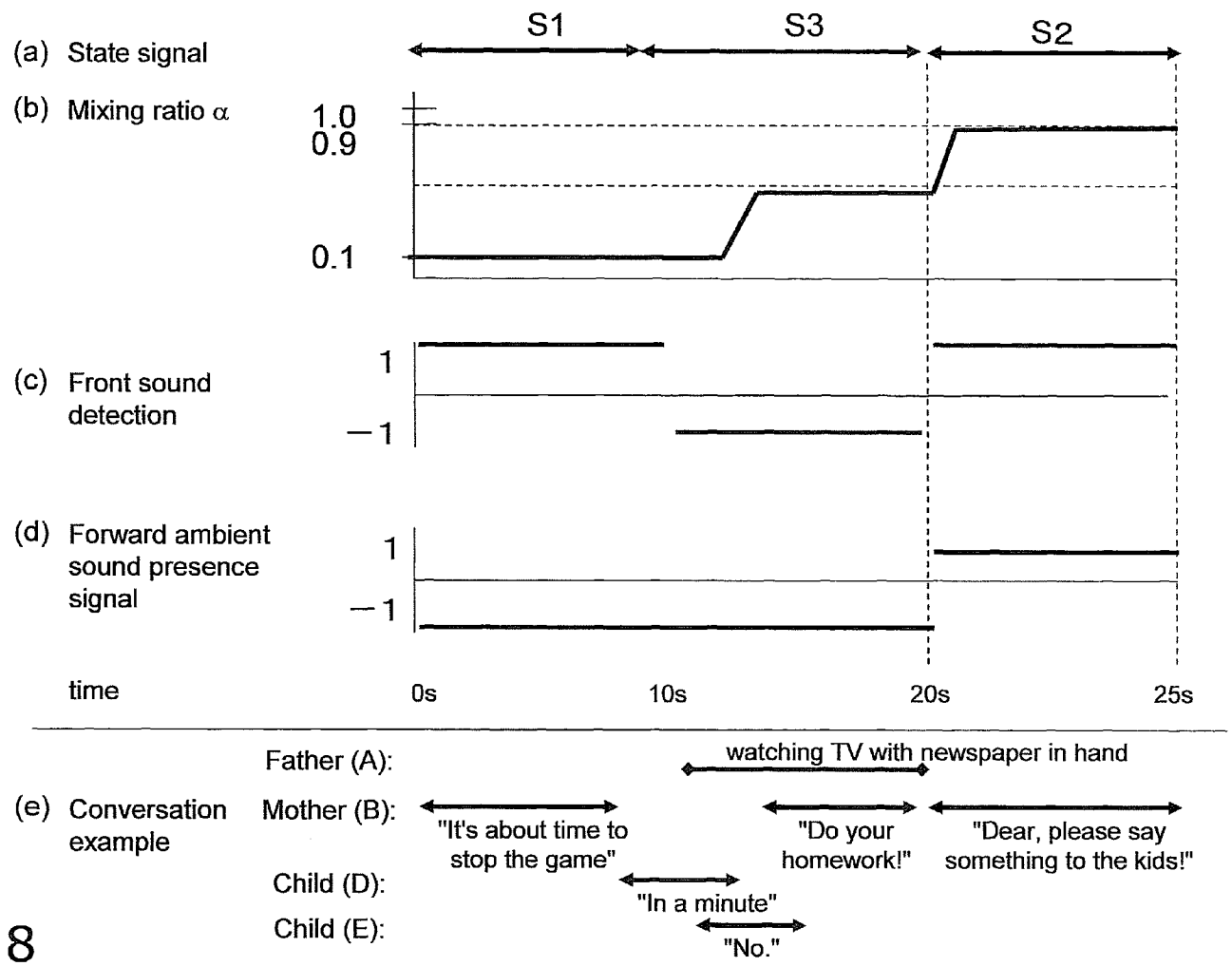
FIGS. 8(*a*) to 8(*e*) are diagrams illustrating another specific operation example for the hearing aid in FIG. 1.
Figure 9:
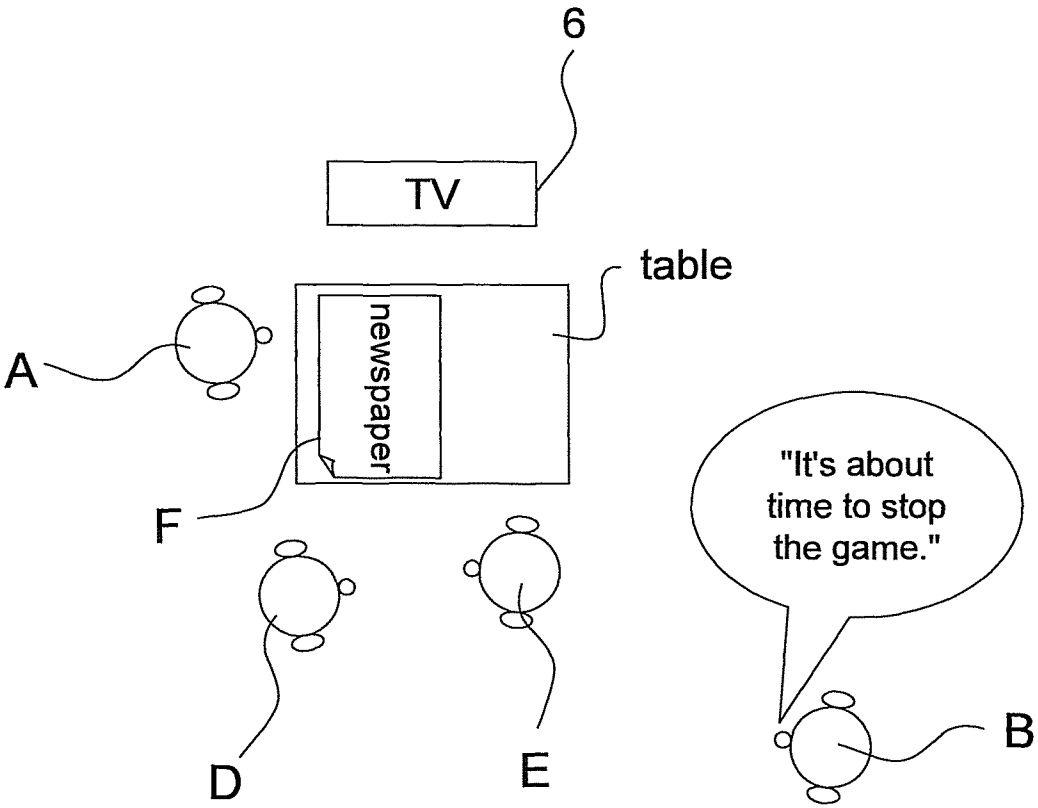
FIG. 9 is a diagram illustrating another specific operation example for the hearing aid in FIG. 1.
Figure 10:
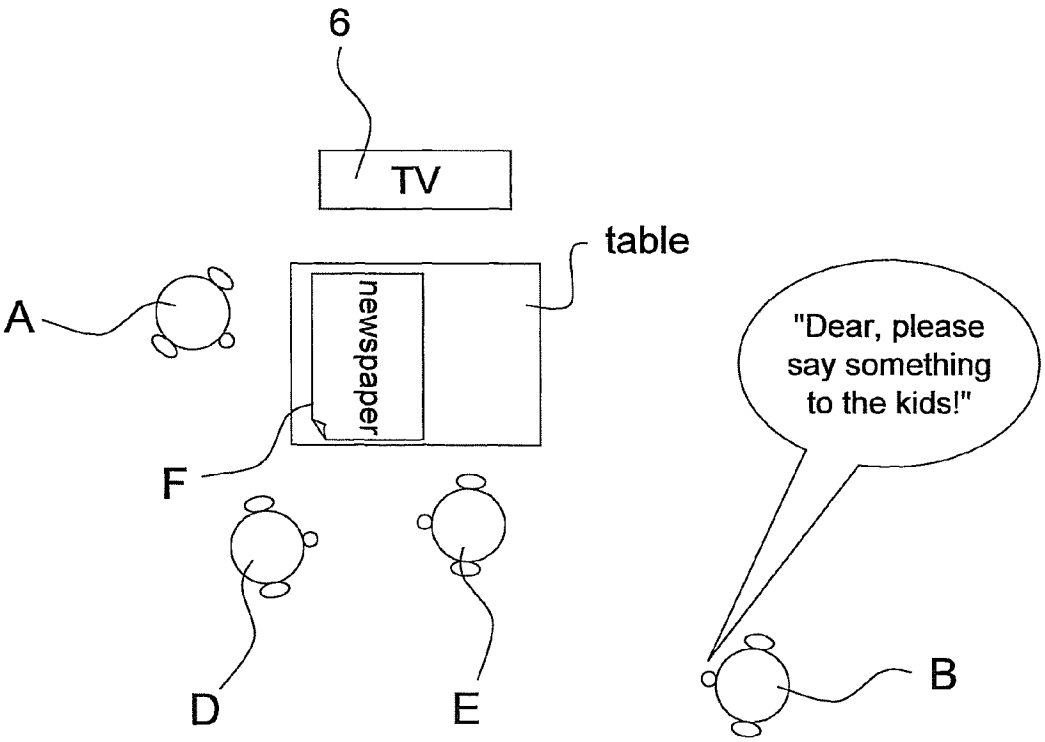
FIG. 10 is a diagram illustrating another specific operation example for the hearing aid in FIG. 1.

More specifically, as shown in FIGS. 8(*a*) to 8(*e*), with the layout shown in FIGS. 9 and 10, first the mother B tells the children D and E that "It's about time to stop the game." In response to this, the children D and E say, "In a minute" and "No." The mother B then yells "Do your homework!," and finally asks for help by saying, "Dear, please say something to the kids!" At this point we will assume that the father A is looking at the television page of the newspaper F to see what other programs are on the television 6.

With a conventional method involving sound pressure, the directional microphone 101 picks up these surrounding voices and changes the mixing ratio, so the father A finds it difficult to hear the sound of the news (the external input sound). Then, about 10 seconds after the start of processing, if the father A turns his head about 45 degrees to the right away from the television set 6 in front of him, for example, and reaches out his hand for the newspaper F lying on the table, which shifts the priority (mixing ratio of 0.9) from the external input to the input of the voices of the surrounding conversation, then the father A will not be able to hear the sound of the news.

In contrast, with the hearing aid 100 pertaining to this embodiment, even if the father A moves his head or picks up the newspaper, since the mother B and the children D and E are not in the front direction of his face, it is possible to avoid changing the value of the mixing ratio $\alpha$ too much with respect to the external input, which would make the news audio (external input) difficult to hear. Also, with the hearing aid 100 of this embodiment, as long as the father A does not move his face by picking up a cup of coffee, the mixing ratio $\alpha$ will remain unchanged at the minimum value of 0.1. Consequently, the father A is not bothered by the voices of the mother B or the children D and E as discussed above, and can clearly hear the audio of the news on the television set 6 inputted as the external input signal 124.

This situation is shown in FIGS. 8(*a*) to 8(*e*). The mixing ratio $\alpha$ and other parameters are the same as in the example shown in FIGS. 6(*a*) to 6(*e*).

Zero seconds after the start of processing, the voice of the mother B saying "It's about time to stop the game" is followed by the response of the children D and E saying "In a minute" and "No," to which the mother B then replies "Do your homework!" In the midst of this, the father A picks up the newspaper. The father A (the user of the hearing aid 100) is not facing the conversing children D and E and mother B even though they are conversing around him, so almost none of the sound other than that of the television set 6 is picked up by the directional microphone 101, so the forward ambient sound presence signal 125 is not +1. Accordingly, the state changes to S3, and the mixing ratio $\alpha$ changes so that the external input and the input of the directional microphone 101 are equal.

After this, in reaction to the mother B's saying "Dear, please say something to the kids!," the father A moves his head toward the mother B as shown in FIG. 10, the voice of the mother B is acquired by the directional microphone 101, and the forward ambient sound presence signal 125 becomes +1. Consequently, the value of the mixing ratio $\alpha$ increases, after which the mixing ratio $\alpha$ increases with respect to conversation (microphone input signal 123), which is necessary to tell the children D and E to stop playing, so the father A naturally and easily hears the conversation around him.

As discussed above, with the hearing aid 100 pertaining to this embodiment, the mixing ratio (priority) a between the microphone input hearing aid signal 128 and the external input hearing aid signal 129 of the user can be suitably varied by means of the input at the directional microphone 101 and the sound acquired by the directional microphone 101, without utilizing facial movements on the part of the user. As a result, the user hears the sounds he is paying attention to more clearly and easily than in the past, so the hearing aid effect is better than in the past.

Main Features

The hearing aid 100 pertaining to this embodiment comprises the directional microphone 101, the external input terminal 102, the hearing aid processor 150, the receiver 113, the mixer 112, the similarity calculator 109, and the mixing ratio decider 111, and the similarity calculator 109 is connected to the mixing ratio decider 111 that decides the mixing ratio between the sound signal inputted to the directional microphone 101 and the sound signal inputted to the external input terminal 102.

The similarity calculator 109 here is provided in order to detect the correlation between the sound from the front direction of the user's face acquired by the directional microphone 101 and the sound inputted to the external input terminal 102, that is, whether or not the two sound signals are similar. More specifically, if the sound in front of the user's face acquired by the directional microphone 101 substantially coincides with the sound acquired from the external input terminal 102, the similarity calculator 109 deems that there is a high correlation between the two signals.

Specifically, this situation is assumed to be one in which the user is facing in the direction of the television set 6, and is watching and concentrating on the television set 6.

Consequently, in a situation in which the user is concentratedly trying to listen to the sound outputted from the television set 6, it is detected whether or not the sound from in front of the user's face is almost exclusively sound from the television set 6, and the sound signal from the external input terminal 102 is given priority over microphone input sound. As a result, the user is not bothered by the chatting voices of surrounding people, in which he has no interest.

Meanwhile, if a family member, for example, speaks to the user in a state in which the sound signal inputted from the external input terminal 102 is given priority over microphone input sound, the similarity calculator 109 and the front sound detector 110 detect that the user has turned his head toward that family member.

Specifically, in this case there is a lower correlation between the sound in the front direction of the user's face acquired by the directional microphone 101 (the voice of a family member) and the sound acquired by the external input terminal 102 (the output sound of the television set 6).

Consequently, the priority of the sound signal outputted from the directional microphone 101 is raised over that of the sound signal inputted from the external input terminal 102 according to facial movement indicating that the intent of the user is to listen to what the family member is saying, and this allows the user to hear clearly what the family member is saying. Thus, the priority of a microphone input signal can be raised over that of an external input signal for a user of the hearing aid 100 who wishes to hear sound acquired from the directional microphone 101.

With the hearing aid 100 of this embodiment, as discussed above, hearing aid processing can be performed that suitably raises the priority of sound according to the intent of the user, so the hearing aid effect is better than in the past.

Also, with the hearing aid 100 of this embodiment, when the front sound detector 110 and the similarity calculator 109 have detected that the user's face is facing in the direction of the television set (external device) 6, the mixing ratio decider 111 changes the mixing ratio $\alpha$ so as to lower the priority of sound acquired by the directional microphone 101.

Consequently, the mixing ratio $\alpha$ can be changed to raise the priority of the external input signal for a user who wishes to hear the output sound of the television set 6 or other external device.

Also, with the hearing aid 100 of this embodiment, when the front sound detector 110 determines that no sound is being acquired from the front direction of the user's face, the mixing ratio $\alpha$ is changed to use as the mean the priority of the sound signal acquired by the external input terminal 102 and the sound signal acquired by the directional microphone 101.

Specifically, with the hearing aid 100 of this embodiment, when no sound is acquired from the front direction of the user, a situation is assumed in which the user is paying attention to his surroundings, and the priority of the sound signals acquired by the directional microphone 101 and the external input terminal 102 are set to be substantially equal (mixing ratio $\alpha \approx 0.5$).

Consequently, a microphone input signal can be provided with the priority required for the user to pay attention to his surroundings. Also, sound acquired by the external input terminal 102 can be similarly heard at this time.

Also, with the hearing aid 100 of this embodiment, the mixing ratio decider 111 has a state detector 201 that distinguishes the state of the user according to whether or not there is sound from the front direction of the user and whether or not there is ambient sound from the front direction of the user, an elapsed time calculator 202 that measures the time that the state detected by the state detector 201 continues, and a mixing ratio calculator 203 that calculates a new mixing ratio $\alpha$ on the basis of the state detected by the state detector 201, the duration calculated by the elapsed time calculator 202, and the immediately prior mixing ratio $\alpha$.

Consequently, the state of the user can be determined by the front sound detector 110 and the similarity calculator 109 on the basis of whether or not there is sound from the front direction of the user and the type of this sound, and the mixing ratio $\alpha$ can be calculated on the basis of how long this state continues.

Also, with the hearing aid 100 of this embodiment, the mixing ratio calculator 203 may be provided with a mixing ratio decision table that allows the mixing ratio $\alpha$ to be decided on the basis of the mixing ratio $\alpha$ upon entering each state, the state detected by the state detector 201, and the duration calculated by the elapsed time calculator 202.

Consequently, hearing aid processing can be performed by using the mixing ratio decision table, without computing the mixing ratio $\alpha$ by table look-up processing, so the proper hearing aid processing can be performed efficiently and as dictated by the situation.

Other Embodiments

An embodiment of the present invention was described above, but the present invention is not limited to or by the above embodiment, and various modifications are possible without departing from the gist of the invention.

(A)

In the above embodiment, an example was described in which the hearing aid processor 150 included the similarity calculator 109, the front sound detector 110, the mixing ratio decider 111, the mixer 112, and so forth, but the present invention is not limited to this.

For example, the mixer and other such components do not necessarily have to be provided within the hearing aid processor, and each of the components, or some of the components, may be provided individually in a serial relation with respect to the hearing aid processor.

(B)

In the above embodiment, an example was described in which the hearing aid 100 made use of the directional microphone 101 to acquire sound in front of the user's face, but the present invention is not limited to this.

Figure 11:
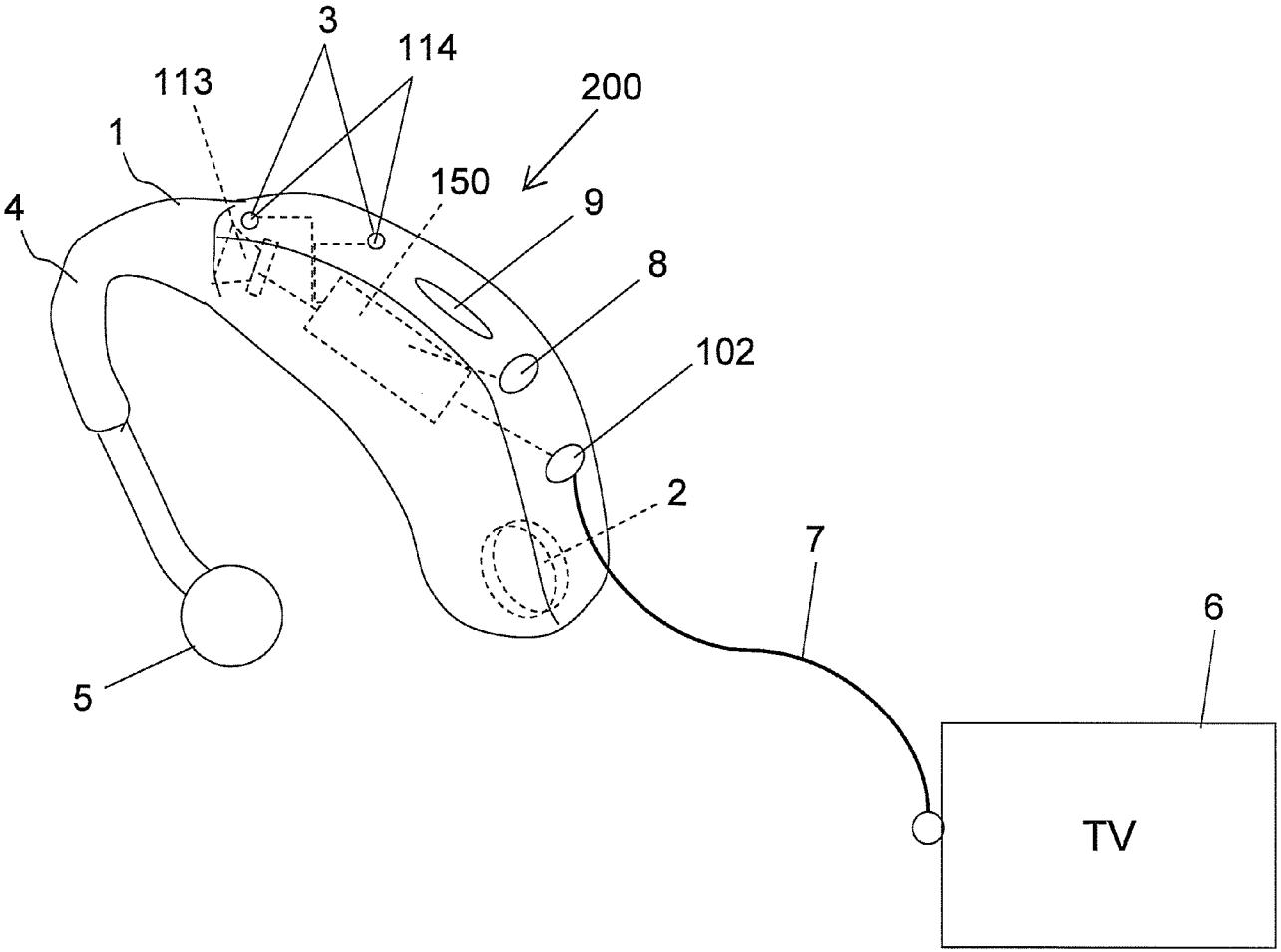
FIG. 11 is an oblique view of the constitution of a hearing aid pertaining to another embodiment of the present invention.

For example, as shown in FIG. 11, non-directional microphones 114 may be disposed one in front of the other in the front direction of the user wearing the hearing aid, and sounds obtained by the two non-directional microphones 114 may undergo signal processing to impart directionality in the front direction of the user's face.

(C)

In the above embodiment, an example was described in which the mixing ratio calculator 203 calculated the mixing ratio α on the basis of the above-mentioned Formula 1, but the present invention is not limited to this.

For example, a table (mixing ratio decision table) for selectively choosing the mixing ratio α on the basis of the duration and the initial value of the mixing ratio α for each state may be readied in a storage means or the like provided inside the hearing aid 100.

This allows the value of the mixing ratio α to be set easily, without having to compute the mixing ratio α.

(D)

In the above embodiment, an example was described in which a television set was used as the external device connected to the external input terminal 102 of the hearing aid 100, but the present invention is not limited to this.

For example, examples of external devices other than a television set include CD/MD players, DVD/HDD recorders, portable audio players, radios, and other such audio devices, car navigation systems, personal computers, and other such information devices, door intercoms and other such home network devices, gas heaters, electromagnetic cooking devices, and other such cooking devices, and the like which may be connected to the hearing aid via the external input terminal 102.

INDUSTRIAL APPLICABILITY

The hearing aid of the present invention has the effect of allowing the hearing aid effect to be improved over that in the past by performing a suitable hearing aid operation according to the movement of the user's head, so it can be widely applied to hearing aids that can be connected by wire or wirelessly to various kinds of external device, such as television sets, CD/MD players, DVD/HDD recorders, portable audio players, car navigation systems, personal computers, and other such information devices, door intercoms and other such home network devices, gas heaters, electromagnetic cooking devices, and other such cooking devices, and so on.

REFERENCE SIGNS LIST

1 main body case
2 battery
3 opening
4 ear hook
5 mounting portion
6 television set (an example of an external device)
7 lead wire
8 power switch
9 volume control
100 hearing aid
101 directional microphone
102 external input terminal
104 subtracter
105 amplifier
106 amplifier
107 hearing aid filter
108 hearing aid filter
109 similarity calculator
110 front sound detector
111 mixing ratio decider
112 mixer
113 receiver
114 non-directional microphone
122 front sound detection signal
123 microphone input signal
124 external input signal
125 forward ambient sound presence signal
126 mixing ratio signal
127 mixing signal
128 microphone input hearing aid signal
129 external input hearing aid signal
150 hearing aid processor
200 hearing aid
201 state detector
202 elapsed time calculator
203 mixing ratio calculator
211 state signal
212 duration-attached state signal

CITATION LIST

Patent Literature

Patent Literature 1: Japanese Laid-Open Patent Application H1-179599

The invention claimed is:

1. A hearing aid, comprising:

a microphone that acquires sound in the front direction of the face of the user in a state of being worn by the user;

an external input terminal that acquires input sound inputted from an external device;

a hearing aid processor that receives sound signals outputted from the microphone and the external input terminal, and subjects the sound signals to hearing aid processing;

a receiver that receives and outputs a sound signal that has undergone hearing aid processing at the hearing aid processor;

a mixer that mixes a sound signal inputted to the microphone with a sound signal inputted to the external input terminal, and outputs a sound signal to the receiver;

a similarity calculator that calculates a correlation between a sound signal inputted from the microphone and a sound signal inputted from the external input terminal; and a mixing ratio decider that decides a mixing ratio between the sound signal inputted to the microphone and the sound signal inputted to the external input terminal at the mixer, on the basis of the calculation result of the similarity calculator, and sends the result to the mixer, wherein when it is detected by the similarity calculator that the correlation is high, the mixing ratio decider decides the mixing ratio so as to lower the priority of the sound signal inputted from the microphone below that of the sound signal inputted from the external input terminal.

2. A hearing aid, comprising:

a microphone that acquires sound in the front direction of the face of the user in a state of being worn by the user;

an external input terminal that acquires input sound inputted from an external device;

a hearing aid processor that receives sound signals outputted from the microphone and the external input terminal, and subjects the sound signals to hearing aid processing;

a receiver that receives and outputs a sound signal that has undergone hearing aid processing at the hearing aid processor;

a mixer that mixes a sound signal inputted to the microphone with a sound signal inputted to the external input terminal, and outputs a sound signal to the receiver;

a similarity calculator that calculates a correlation between a sound signal inputted from the microphone and a sound signal inputted from the external input terminal;

a mixing ratio decider that decides a mixing ratio between the sound signal inputted to the microphone and the sound signal inputted to the external input terminal at the mixer, on the basis of the calculation result of the similarity calculator, and sends the result to the mixer; and a front sound detector that determines whether or not a sound source is in the front direction on the basis of sound acquired by the microphone, wherein when it is detected by the front sound detector that no sound information is included in a sound signal acquired by the microphone, the mixing ratio decider decides the mixing ratio so that the priority will be substantially equal between a sound signal acquired by the microphone and a sound signal acquired by the external input terminal.

3. The hearing aid according to claim 2, wherein the mixing ratio decider has:

a state detector that detects the state of the user, decided by whether or not the front sound detector determines a sound in the front direction is included, and whether or not the sound is an external input signal;

an elapsed time calculator that measures how long the state detected by the state detector has continued; and a mixing ratio calculator that calculates a new mixing ratio on the basis of the mixing ratio from immediately before the continuation time calculated by the elapsed time calculator and the state detected by the state detector.

4. The hearing aid according to claim 3, wherein the mixing ratio decider further has a mixing ratio decision table that allows the mixing ratio to be decided by the mixing ratio calculator on the basis of the initial value for the mixing ratio upon entering each state detected by the state detector, and the duration calculated by the elapsed time calculator, and decides a new mixing ratio on the basis of the mixing ratio decision table.

* * * * *